United States Patent [19]

Kaiser et al.

[11] 4,300,370

[45] Nov. 17, 1981

[54] SECURING DEVICE COMPRISING PADLOCK AND ANCHORED HOUSING

[75] Inventors: Donald J. Kaiser; Albert Behar; William A. Krupicka, all of Charlotte, N.C.

[73] Assignee: Scoville Inc., Waterbury, Conn.

[21] Appl. No.: 136,794

[22] Filed: Apr. 3, 1980

[51] Int. Cl.[3] ..... E05B 67/38
[52] U.S. Cl. ..... 70/54
[58] Field of Search ..... 70/55, 54, 56, 417, 70/14; 150/52

[56] References Cited

U.S. PATENT DOCUMENTS

| | | | |
|---|---|---|---|
| 1,291,993 | 1/1919 | Matthews | 70/55 |
| 2,766,605 | 10/1956 | O'Brien | 70/417 |

FOREIGN PATENT DOCUMENTS

| | | | |
|---|---|---|---|
| 400959 | 8/1924 | Fed. Rep. of Germany | 70/55 |
| 1365684 | 9/1974 | United Kingdom | 70/54 |

*Primary Examiner*—Robert L. Wolfe
*Attorney, Agent, or Firm*—Dallett Hoopes

[57] ABSTRACT

For locking an object to a stationary structure, a securing device comprising an ordinary padlock, a C-shaped housing embracing the body of the padlock, the top of the housing being apertured to receive the shackle of the padlock, and fastening means to hold the housing to the structure.

5 Claims, 5 Drawing Figures

SECURING DEVICE COMPRISING PADLOCK AND ANCHORED HOUSING

BACKGROUND OF THE INVENTION

1. Field of the Invention

This invention relates to securing devices. More specifically, this invention relates to means for anchoring conventional padlocks to an immoveable structure so that any object chained to the padlock shackle is securely held against removal.

2. Description of the Prior Art

In the prior art generally, means of securing items by padlock to a stationary structure have involved the threading of the padlock shackle through both ends of a chain. Between its ends, the chain goes around a part of the object to be secured and around the immoveable structure. Thus, for instance, in securing a bicycle to a bike rack, the chain has passed through the wheel of a bicycle, through part of the rack structure, and both ends of the chain have been secured to the padlock shackle in a conventional manner.

SUMMARY OF THE INVENTION

Under the present invention, the body of the padlock itself is secured by means of a special housing comprising part of the invention to the immoveable structure by means of fastener elements passing through the housing and into the structure. A chain or cable is then simply passed around the object to be locked and both ends of the chain are secured in the padlock. More specifically, the invention comprises the combination of a conventional padlock, a C-shaped housing adapted to embrace the padlock body, and fastener elements securing the housing to an immoveable structure.

BRIEF DESCRIPTION OF THE DRAWINGS

Further objects and features of the invention will be apparent from the following specification and claims including the attached drawings, all of which disclose a non-limiting embodiment of the invention. In the drawings:

Figure 1:
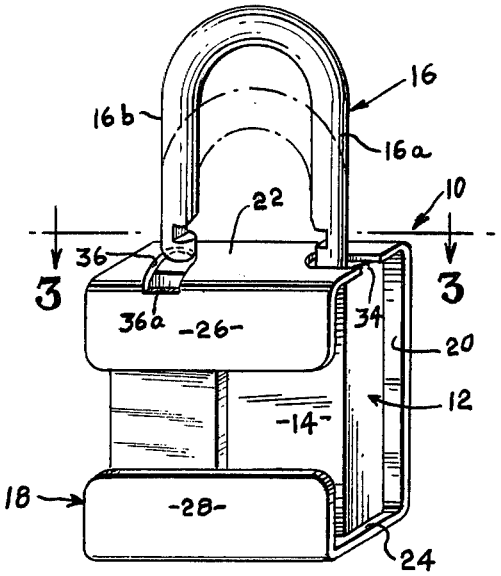
FIG. 1 is a perspective view of a securing device embodying the invention of a padlock in open condition in full lines and in locked position in phantom.

Referring more specifically to the drawings, a securing device embodying the invention is generally designated 10 in FIG. 1. It comprises a conventional padlock 12 having a body 14 of generally rectangular solid shape and a conventional shackle 16.

Figure 2:
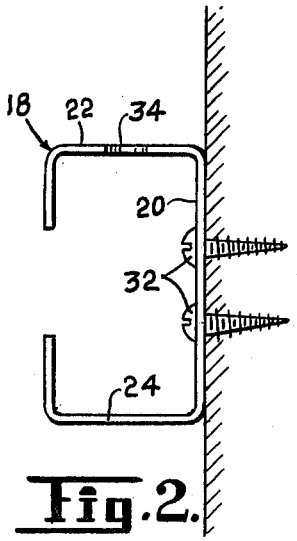
FIG. 2 is a side view of the housing and fastening device.

Embracing the padlock, as shown, is a C-shaped housing 18 (FIG. 2), preferably of metal. The housing comprises a rear panel 20, a top panel 22, a bottom panel 24 and front partial end panels 26 and 28.

Figure 5:
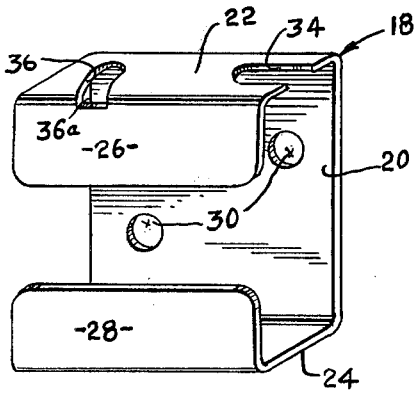
FIG. 5 is a perspective view of the housing without its associated padlock.

As shown in FIG. 5, the rear panel 20 may be apertured as at 30 to prevent the passage of headed fasteners 32.

Figure 3:
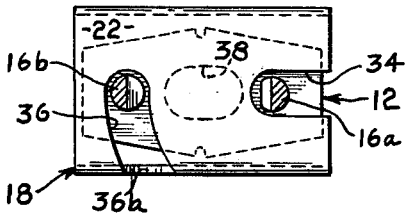
FIG. 3 is a sectional view taken on the line 3—3 of FIG. 1.

The top panel 22 (FIG. 3) is notched as at 34 to receive the attached leg **16*a* of the shackle 16. Additionally, the panel 22 is formed with an arcuate opening 36 to permit passage of the distal leg 16*b* of the shackle through the top panel. As shown, the opening 36 is preferably arcuate, generally following the arc of the swing of the end of the distal leg when the padlock is in place. It should be noted that the opening 36 extends forward as at 36*a* to the top edge of the front panel 26**.

Figure 4:
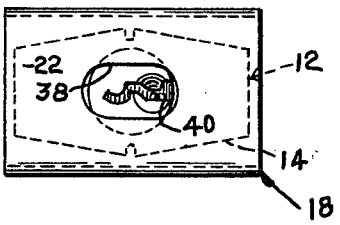
FIG. 4 is a bottom plan view.

As shown in FIG. 4, the bottom wall 24 is formed with an oblong opening 38 to permit passage of the key into the lock keyway 40.

In use, the housing 18 is secured against a stationary object such as a wall, or post, by headed fasteners such as 32. When it is desired to secure an object to the wall or post, an open padlock 12 is inserted in the housing by sliding the body 14 laterally into the housing with the padlock open. The installation is complete when the attached leg **16*a* hits the inner margin of the cut-out 34. The shackle 16 is then threaded through the opposite end loops of the chain which has been looped about the object to be secured. The shackle is then brought into closing position with the distal leg 16*b* over its opening in the body 14 and the shackle is pressed downwardly to snap closed. When the lock is closed, the interference of panel 22 with the shackle 16** prevents the lateral movement of the padlock.

The purpose of the arcuate opening 36 is to assure clearance of the leg **16*b*** as it is swung in opening or closing.

When it is desired to open the padlock, a key is inserted through the housing opening 38, into the keyway 40, and the key is turned, as in conventional. After the shackle pops up in unlocked condition, the shackle is then pivoted about its attached leg **16*a*** to make the ends of the chain removable. The padlock can then be removed from the housing if desired or necessary.

By the above arrangement, there is provided a simple and inexpensive way to secure a padlock to an immoveable object and hence secure a chain and object to be locked to the immoveable object. The arrangement also permits the storage of the padlock and chain, if desired, when the two are not in use.

The invention is not limited to the structure shown but can be defined in the terms of the following claim language and full equivalents thereof.

We claim:

1. A securing device comprising:

(a) a conventional padlock having a body of generally rectangular solid shape and a U-shaped shackle adapted, when the padlock is not locked, to raise longitudinally from the body and present an attached leg and a distal leg, the shackle pivoting about the attached leg, all in the conventional manner, and a keyhole at the other end of the body from the shackle;

(b) a C-shaped housing of rigid sheet material comprising a back panel, top and bottom panels and shortened upper and lower front panels, the panels defining a pocket adapted to receive the body of the padlock from a lateral direction, the top panel being laterally notched to receive the attached leg and having an opening to permit the distal leg to pass through in the locking operation, and having an opening in the bottom panel to expose the keyhole; and (c) means to fasten the housing to a stationary member.

2. A securing device as claimed in claim 1 wherein the opening in the top panel is arcuate, generally following the arc of the swing of the end of the distal leg.

3. A securing device as claimed in claim 2 wherein the opening in the top panel extends forward to the edge of the front panel.

4. A securing device comprising a padlock and a C-shaped rigid housing open at its opposite sides, its top wall having portions removed, the housing receiving the body of the padlock through one of the open sides when the padlock is unlocked, the portions removed permitting passage of the distal and attached ends respectively of the padlock shackle for locking purposes, and headed fastening means passing through the rear wall of the housing for securing the housing to a stationary object.

5. A securing device as claimed in claim 4 wherein one of the portions removed is arcuate and generally follows the arc of the swing of the end of the distal leg of the padlock shackle.

* * * * *

UNITED STATES PATENT AND TRADEMARK OFFICE

CERTIFICATE OF CORRECTION

PATENT NO. : 4,300,370

DATED : November 17, 1981

INVENTOR(S) : Donald J. Kaiser et al.

It is certified that error appears in the above—identified patent and that said Letters Patent is hereby corrected as shown below:

Delete the Figure of drawing on the title page and substitute the attached sheet therefor.

On the title page, Item [73], "Scoville Inc., Waterbury, Conn." should read -- Scovill Inc., Waterbury, Connecticut --.

UNITED STATES PATENT AND TRADEMARK OFFICE

CERTIFICATE OF CORRECTION

PATENT NO. : 4,300,370 Page 2 of 2

DATED : November 17, 1981

INVENTOR(S) : Donald J. Kaiser et al.

It is certified that error appears in the above—identified patent and that said Letters Patent is hereby corrected as shown below:

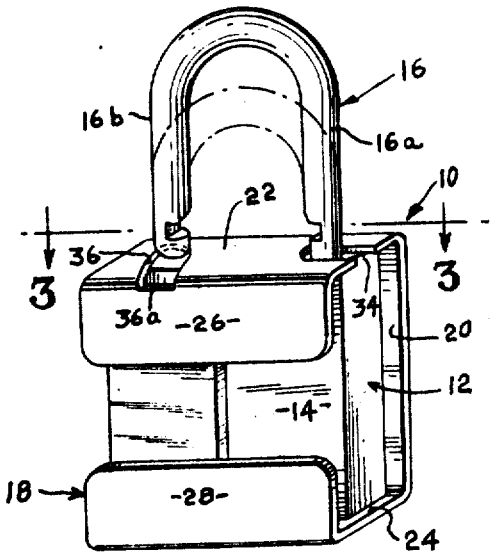

Signed and Sealed this

Second Day of February 1982

[SEAL]

Attest:

GERALD J. MOSSINGHOFF

Attesting Officer

Commissioner of Patents and Trademarks